US008328073B1

(12) United States Patent
Smith et al.

(10) Patent No.: US 8,328,073 B1
(45) Date of Patent: Dec. 11, 2012

(54) ORNAMENTED METALLIC MESH AND METHOD OF MAKING SAME

(75) Inventors: Gregory C. Smith, North Attleboro, MA (US); Robert S. Bevelacqua, Plainville, MA (US)

(73) Assignee: Standard Chain Co., North Attleboro, MA (US)

( * ) Notice: Subject to any disclaimer, the term of this patent is extended or adjusted under 35 U.S.C. 154(b) by 885 days.

(21) Appl. No.: 12/124,296

(22) Filed: May 21, 2008

Related U.S. Application Data

(60) Provisional application No. 61/026,820, filed on Feb. 7, 2008.

(51) Int. Cl.

| | |
|---|---|
| ***A44C 17/02*** | (2006.01) |
| ***A44C 17/04*** | (2006.01) |
| ***A44C 27/00*** | (2006.01) |
| ***B23P 5/00*** | (2006.01) |

(52) U.S. Cl. ..... 228/122.1; 63/26; 63/37; 29/10; 29/896.4; 29/896.41; 29/896.43

(58) Field of Classification Search ..... 228/122.1; 63/26, 37; 29/10, 896.4–896.43; 427/260, 427/367, 368, 375

See application file for complete search history.

(56) References Cited

U.S. PATENT DOCUMENTS

| | | | | | |
|---|---|---|---|---|---|
| 1,602,847 | A | * | 10/1926 | Dover | 63/33 |
| 1,904,241 | A | * | 4/1933 | Kammerer | 428/656 |
| 2,102,746 | A | | 12/1937 | Reilly | |
| 2,920,442 | A | | 1/1960 | Kunzmann et al. | |
| 3,482,300 | A | | 12/1969 | Reinke | |
| 3,634,917 | A | | 1/1972 | Kortick | |
| 3,649,865 | A | | 3/1972 | Holmes | |
| 3,886,051 | A | * | 5/1975 | Albright et al. | 205/195 |
| 4,246,322 | A | * | 1/1981 | Wall et al. | 428/670 |
| 4,543,803 | A | * | 10/1985 | Keyasko | 63/37 |
| 5,077,988 | A | * | 1/1992 | Poll | 63/26 |
| 5,225,059 | A | * | 7/1993 | Penrose | 204/212 |
| 5,259,101 | A | * | 11/1993 | Katz | 29/896.41 |
| 5,285,659 | A | * | 2/1994 | Bardisbanyan | 63/26 |
| 6,212,745 | B1 | * | 4/2001 | Pierre et al. | 29/10 |
| 2003/0106800 | A1 | * | 6/2003 | Schlanger | 205/76 |

* cited by examiner

*Primary Examiner* — Jessica L Ward
*Assistant Examiner* — Devang R Patel
(74) *Attorney, Agent, or Firm* — Salter & Michaelson

(57) ABSTRACT

A mesh structure to which is mounted one or more ornamental stones. The mesh structure includes a series of chain links that are inter-woven. A thin metallic film in the form of a solder layer is hardened onto the surface of the mesh structure so as to make the mesh structure rigid. One or more settings are drilled into the rigid mesh structure, and a stone is disposed in each of the settings that are provided. A series of prongs are formed about the periphery of each of the so-disposed stones by up-setting the mesh.

14 Claims, 8 Drawing Sheets

ORNAMENTED METALLIC MESH AND METHOD OF MAKING SAME

RELATED APPLICATION

Priority for this application is hereby claimed under 35 U.S.C. §119(e) to commonly owned and U.S. Provisional Patent Application No. 61/026,820 which was filed on Feb. 7, 2008. The content of all of the aforementioned application is hereby incorporated by reference herein in its entirety.

FIELD OF THE INVENTION

The present invention relates in general to metallic mesh, also known in the field as Milanese mesh. Mesh of this type, which is well known in the art, is an intricate mesh made from spiral wires braided together to form a flexible mesh traditionally used to make necklaces and bracelets, although not necessarily limited to such use. The present invention also pertains to an improved method of making a metallic mesh product of this type that can effectively support ornamental jewels, stones or the like in an effectively permanent manner.

BACKGROUND OF THE INVENTION

The basic concept of the present invention involves the attachment of ornamental stones, or the like, to a metallic mesh to provide enhanced ornamentation for the product with which the mesh is used, such as a bracelet or necklace. Since, however, the Milanese mesh is traditionally flexible, it has been found that this inherent flexibility, and the attendant movement of the mesh during normal use, makes it difficult for ornamental stones or the like to be affixed to the mesh in a permanent fashion. The movement of the mesh is likely to cause the stones to loosen and separate from their settings.

Accordingly, it is an object of the present invention to provide an improved metallic mesh product and an associated improved method of making the metallic mesh product.

Another object of the present invention is to provide an improved method of making a Milanese mesh in which jewels, stones, or the like pieces can be effectively and permanently mounted in the mesh material.

Still another object of the present invention is to provide improved metallic mesh product and an associated improved method of making the metallic mesh product in which the method can be carried out inexpensively.

SUMMARY OF THE INVENTION

In accordance with the present invention there is provided a treatment of the mesh to eliminate the flexibility of at least portions thereof before the stones or jewels are set. In accordance with the present invention, before the ornamental stones are applied to the mesh, the mesh goes through a treatment which eliminates the flexibility thereof, so that when the ornamental stones are affixed to the now-rigid mesh, there is little likelihood of the stones becoming inadvertently displaced. Once the mesh has been treated so as to assume its rigid form, ornamental stones or the like may be applied thereto in any desired pattern by means hereinafter described.

In accordance with one aspect of the present invention there is provide a method of attaching one or more stones or jewels to a flexible metallic mesh structure. This method comprises the steps of: applying a metallic film over the mesh structure; heating the mesh structure so as to form a rigid mesh structure; establishing a setting in the rigid mesh structure; disposing the stone or jewel in the established setting; and forming prongs over portions of the stone or jewel by upsetting areas of the rigid mesh structure around the stone or jewel.

In accordance with still other aspects of the present invention there is provided in the method wherein the metallic film is in the form of a liquid paste and the step of applying the liquid paste includes brushing the paste on the mesh structure using a brush; the heating step includes passing the mesh structure through a furnace so as to form a thin metallic layer over the mesh structure to make the mesh structure rigid; the mesh structure is cleaned before applying the metallic film; after removal from the furnace, the rigidized mesh is then cleaned and tumbled; the setting is formed as a conical aperture in an area between links of the mesh structure; the prongs are disposed at spaced intervals about the stone and comprise at least three; the heating step includes passing the mesh structure on a belt through a furnace so as to form a thin metallic layer over the mesh structure to make the mesh structure rigid; the step of establishing the setting includes drilling a hole in the rigid mesh structure and forming a conical aperture by means of a conical shaped bit; and the prongs are formed by means of a forming tool that provides the prong that extends over a peripheral edge of the stone.

In accordance with a further aspect of the present invention there is provided a mesh structure to which is mounted one or more ornamental stones, said mesh structure comprised of a series of chain links that are inter-woven; a thin metallic film in the form of a solder layer that is hardened onto the surface of the mesh structure so as to make the mesh structure rigid; one or more settings drilled into the rigid mesh structure; a stone disposed in each of the settings that are provided; and a series of prongs that are formed about the periphery of each of the so-disposed stones.

In accordance with still further aspects of the present invention the solder layer is in the form of a liquid paste and the solder layer is applied by brushing onto the mesh structure; in combination with a furnace for providing the hardening of the mesh structure; wherein the mesh structure is cleaned before applying the solder layer; wherein after removal from the furnace, the rigidized mesh is then cleaned and tumbled; the setting is formed as a conical aperture in an area between links of the mesh structure; the prongs are disposed at spaced intervals about the stone, include a projection over an edge of the stone and comprise at least three; each of the prongs are formed in combination with a forming tool that up-sets an area of the rigid mesh structure about the stone setting; the forming tool is disposed at an angle to the mesh structure surface and the setting includes drilling a hole in the rigid mesh structure and forming a conical aperture by means of a conical shaped bit; and the series of prongs are spacedly disposed about the periphery of the setting.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE INVENTION

Figure 1:
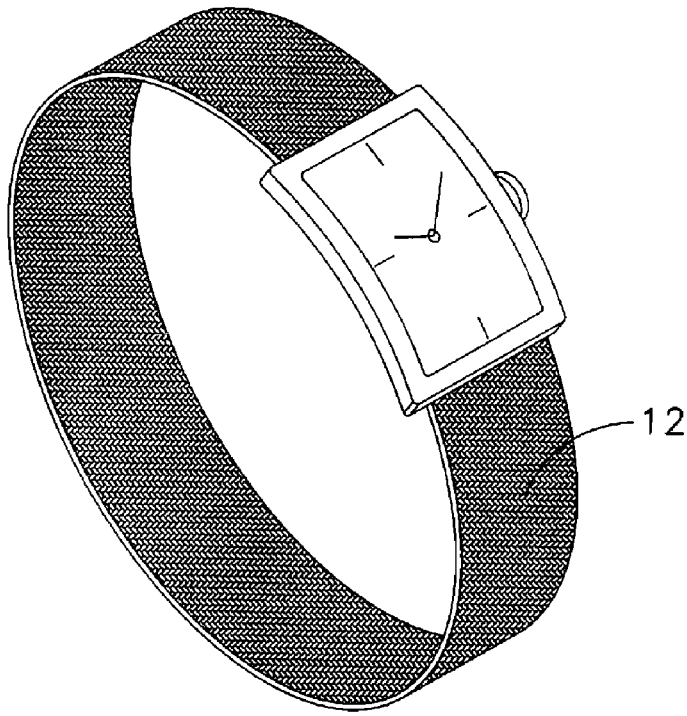
FIG. 1 is an illustration of traditional Milanese Mesh used as a bracelet for wristwatches.
Figure 2:
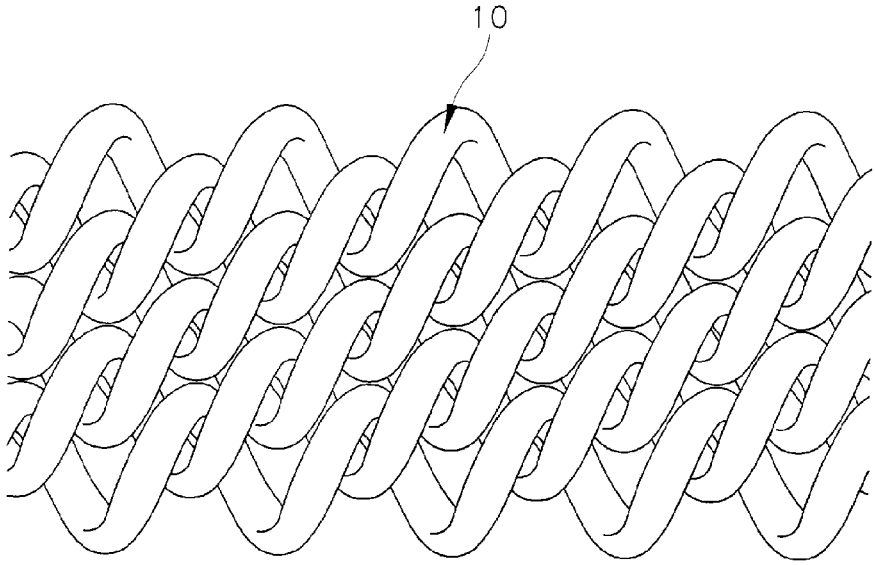
FIG. 2 illustrates a portion of a mesh chain prior to the freezing step.
Figure 3:
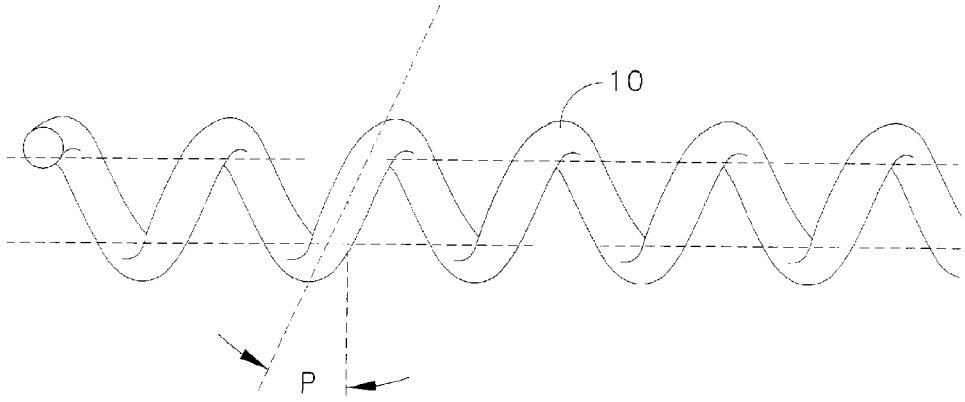
FIG. 3 illustrates one section of chain that comprises the mesh product.

The metallic mesh of the present invention, or Milanese Mesh, as it is sometimes referred to, is predominantly made from wire, which has been wound or coiled into what may be called springs or spirals. These springs or spirals are then woven into each other, using one to fasten to the next, as show at, for example, 10 in FIGS. 2 and 3. FIG. 2 illustrates a portion of a mesh chain prior to the freezing step, while FIG. 3 illustrates one section 10 of chain that comprises the mesh product. As the metallic mesh product is well known iot is not described in great detail herein. It is understood that the mesh 10 shown in FIGS. 2 and 3, as well as in other drawings herein, is an enlarged showing of metallic mesh. Reference is also made to FIG. 1 herein where the mesh is shown at 12 in FIG. 1 as being used as a bracelet or strap for wristwatches or the like. Of course, the mesh that is described herein may be used for any application where a mesh product is useable.

It will be understood that different looks may be obtained when using metallic mesh as a result of different specifications of the inter-woven, coiled or spring-like wires which make up the mesh 10. In this regard refer to FIG. 3 herein for an enlarged view of a typical spiral and illustrating the pitch of the spiral. Specifications for the mesh include such parameters as: diameter of the wire, inside diameter of the coil, and the pitch, which dictates the tightness, or looseness of the individual weaves. For example, a mesh made from 0.032 diameter wire has larger, natural apertures than a mesh made from 0.018 diameter wire. If the apertures of the mesh are larger, then there needs to be less drilling to prepare the settings for receiving the ornamental stones, as will be hereinafter described in more detail.

The traditional Milanese Mesh has been used because of the inherent flexibility of the mesh. However, where the mesh is flexible, it has been found that ornamental stones applied to the mesh have a tendency to loosen and pop out as a result of repeated flexing of the mesh. Accordingly, it is an important feature of the present invention that before setting the ornamental stones in the mesh, the mesh is to be treated so as to eliminate the flexibility thereof; i.e., the mesh, in whatever shape it may comprise, is completely rigid and un-flexible, or at least portions of the mesh are so rigid. This is done by coating the mesh with an agent, such as solder, for example, and then introducing the coated mesh into a furnace so that whatever shape has been applied to the mesh will be rigidly maintained. This "rigidizing" process permits the traditionally flexible woven mesh to be used as though it were a solid material.

By using a specific combination of solder having a binder therein, with the right blend and consistency, combined with proper application techniques and specific governed temperatures, the rigidizing of the mesh preferably takes place without the solder being visual. In other words the solder forms a thin layer on and around each of the links of the mesh chain. As previously stated, if ornamental stones were applied to the mesh in its flexible form, although the stones could be set into the mesh, the normal movement of the mesh during use of the product would cause the stones to loosen and fall out from their settings. However, by first utilizing solder or the like to rigidize the mesh, after it has been manipulated to its desired shape, the ornamental stones have no tendency to loosen and become displaced.

Before coating the mesh with a rigidizing agent, such as solder, the mesh is to be cleaned so as to be free of oil or other contaminants. The cleaning of the metal mesh is done in what would be considered a traditional precious metal operation. It is first introduced into an ultra sonic bath; then rinsed in clean water; then: put into a "pickle" bath; then rinsed again. The mesh work piece then should be completely dried with either a spin dryer or with hot air.

Figure 4:
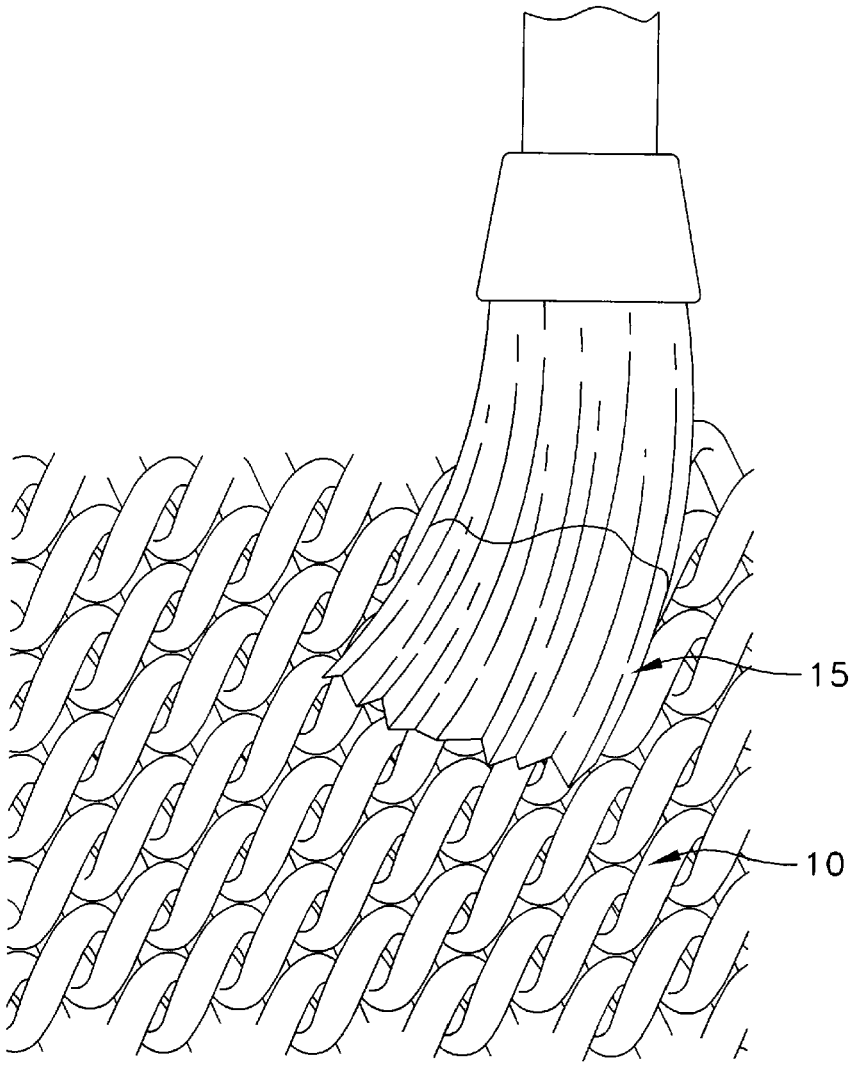
FIG. 4 illustrates an initial step in the process of brushing on the solder material.

The rigidizing agent, which is semi-liquid in state (a paste), is then painted or coated over the mesh utilizing any appropriate brush, it being understood that different sizes and densities of brush bristles are used for different size meshes. In this regard refer to FIG. 4 herein for a schematic illustration of the brushing or painting step using the brush 15 on the mesh 10. The amount of rigidizing agent applied to the mesh is important to the clarity and rigidity of the final product. The correct amount may be achieved by trial and error testing with different amounts being used for different weaves and products. Any excess rigidizing agent is removed from the mesh by either wiping or brushing it away. The excess may be wiped away with a damp cloth. The step of applying the paste preferably uses a brush and the paste is preferably applied or painted on with a cross-hatch brush stroke. The solder is applied so that neither too little nor too much is applied. Too much solder applied does not melt consistently and too little solder does not provide a sufficiently rigid structure.

After the rigidizing agent has been applied to the mesh, the mesh is run through a furnace, it being understood that the type of mesh, style and make-up of forms used and the number of products that are being processed determines temperatures and belt speeds, which again can be determined by trial and error. The duration of time in the furnace, along with the furnace temperature is selected to provide a smooth metallic finish over the entire surface being treated.

After removal from the furnace, the rigidized mesh is then cleaned and tumbled, as is well known in the art, to enhance the luster of the mesh. A similar process may be used as listed above before soldering. This may include additional finishing in vibratory tubs and traditional tumbling machines that have mixtures of media. The media are small particles of round ball shot steel and or conical plastics or ceramics which spin or revolve in a combination of this media and soaps and water to achieve the luster of the metal.

Figure 5:
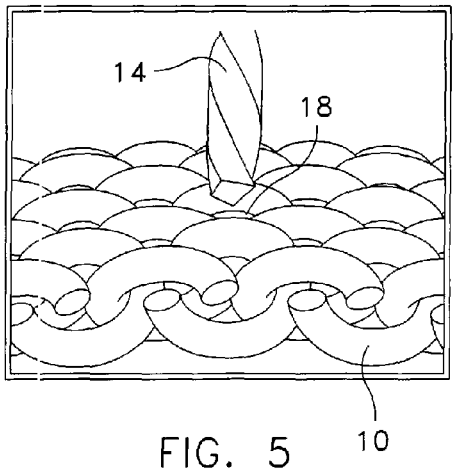
FIG. 5 illustrates a portion of a mesh chain including applying a drill thereto for forming a stone setting.
Figure 7:
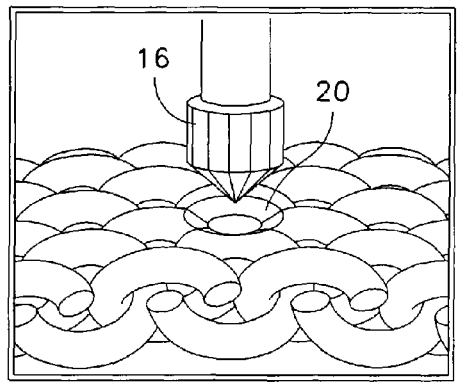
FIG. 7 is an illustration showing the chain with a finish bit used in the process of forming the setting.
Figure 6:
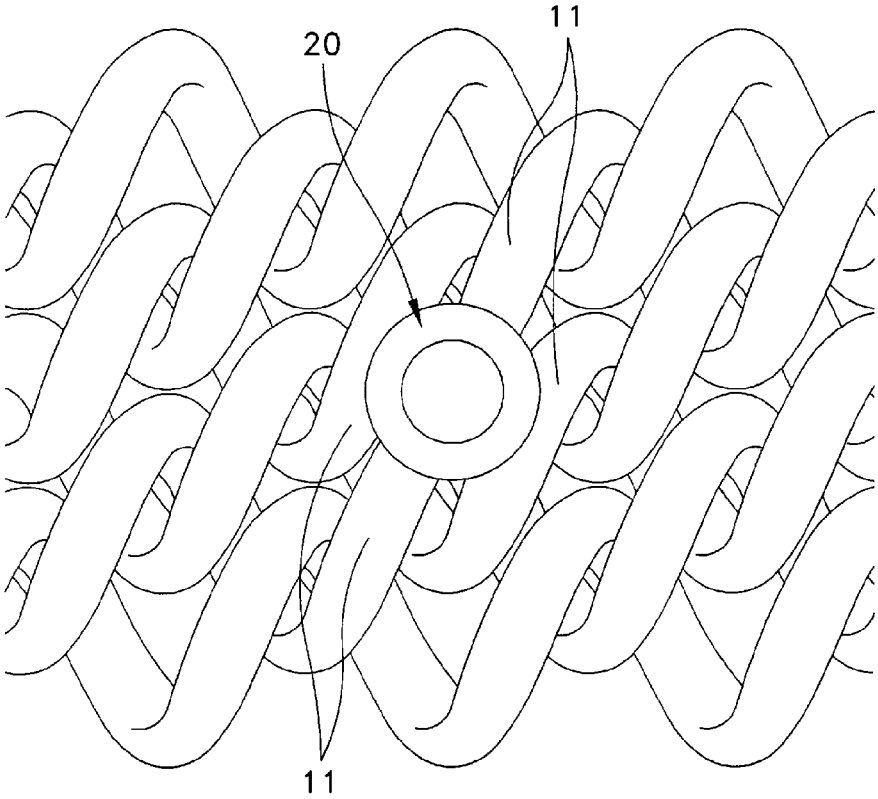
FIG. 6 is a plan view showing the drilled stone setting in the area of an aperture of the mesh.

After the mesh 10 has been rigidized, a drill 14 is used to create the aperture 18 as shown in FIG. 5. This may be used to form an initial hole of the aperture. FIG. 7 illustrates a further drill bit 16 at its lower end which is aligned with one of the apertures 18 and lowered to form a setting 20, as shown in FIG. 7. This setting 20 is preferably a conical seat. The position of the aperture 18 is preferably at an area where there is an existing aperture between the chain links, as is illustrated in FIG. 6. FIG. 6 is a plan view and thus shows the setting 20 disposed between the chain links 11. These links are disposed in a way that there is a natural space between adjacent ones thereof where the drill bit can be registered in forming the setting 20.

Figure 8:
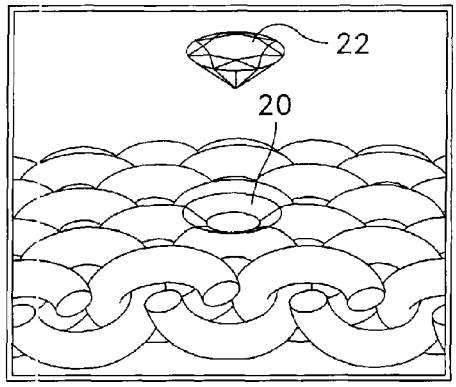
FIG. 8 shows the mesh chain with the setting therein and with an ornamental stone positioned to be placed in the setting.
Figure 9:
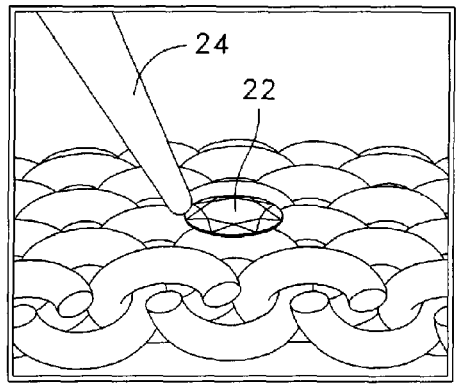
FIG. 9 shows the mesh chain with the stone in the setting and with a forming tool in position to offset metal from the chain to overlap spaced edges of the stone to retain it in its setting.
Figure 10:
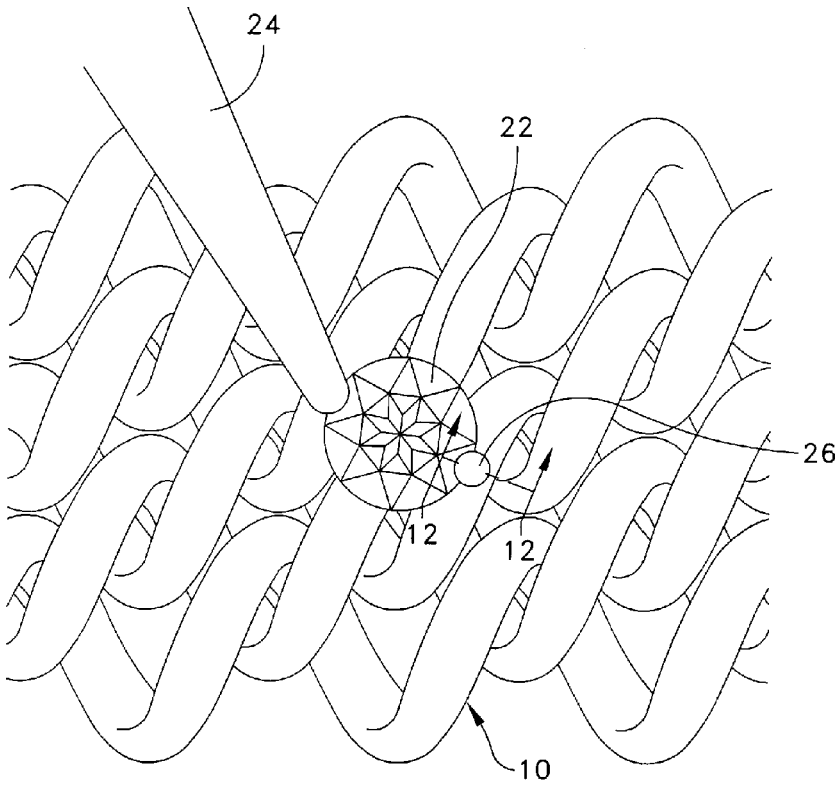
FIG. 10 is a plan view that shows the stone with an offset holding tab or prong already in place and another one in the process of being formed.
Figure 11:
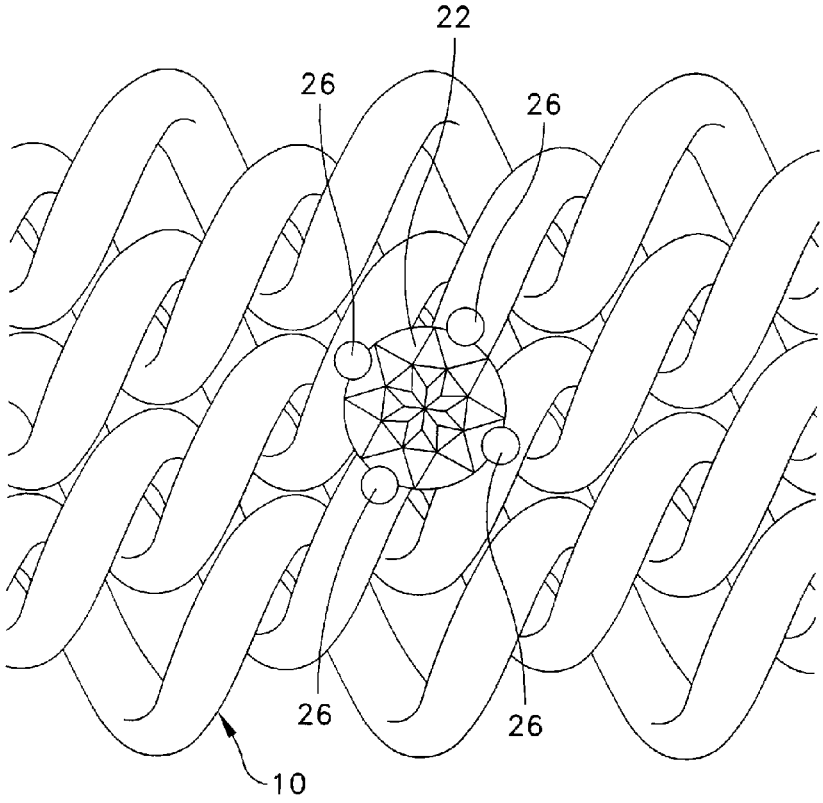
FIG. 11 is a plan view that shows the stone fully captured in its setting in the chain.

After the setting 20 has been formed, an ornamental stone 22, shaped to fit snugly within setting 20, is positioned within the setting, as shown in FIGS. 8 and 9. The tool 24 is used to form tabs or prongs 26 that maintain the stone 22 within the setting 20. The forming tool 24 is employed as illustrated in FIGS. 9 and 10. The tool is applied under pressure at a plurality of spaced edges of the setting to offset metal from the chain 10 to form holding tabs or prongs 26 which overlie the peripheral edge of stone 22, preferably, but not necessarily, at four spaced locations, as shown most clearly in FIGS. 10 and 11.

Figure 12:
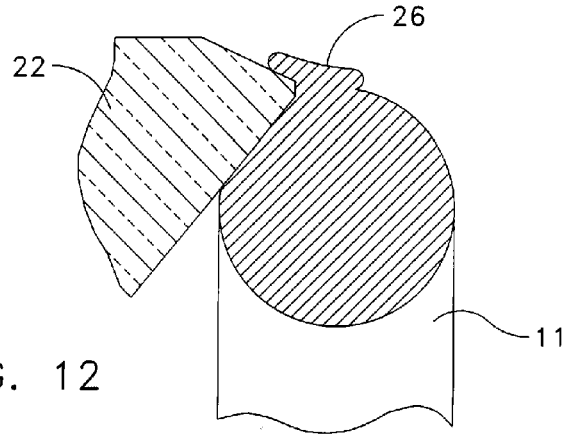
FIG. 12 is a cross-sectional view taken along line 12-12 0f FIG. 10 showing the manner in which the retaining prong is formed.

The securing of the stone is done by hand, with the stone in place. As illustrated in FIGS. 9, 10 and 12, metal from the tops of the surrounding spirals is "chiseled" or moved to create a metal prong 26 that extends out over the stone. Metal punches and hammers are used to make the indentation into the spiral to move the metal into the prong-like position. The tool 24 is preferably oriented on an approximately 75-80 angle to the plane of the mesh.

As will be obvious, any desired number of ornamental stones may be affixed to chain 10 at desired locations to form an aesthetically pleasing look to the chain. Since the chain is rigid in whatever form it is in, no bending or twisting of the chain can take place, as a result of which the stones that have been set in the chain maintain their position with little likelihood of inadvertent displacement therefrom.

Having now described a limited number of embodiments of the present invention it should now be apparent to those skilled in the art that numerous other embodiments and modifications thereof are contemplated as falling within the scope of the present invention, as defined by the appended claims.

What is claimed is:

1. A method of attaching one or more stones or jewels to a flexible metallic mesh structure that is formed of a myriad of interconnected wound links, comprising the steps of:

coating a metallic film over the mesh structure;

said metallic film being coated in the form of a solder layer;

heating the mesh structure and the solder layer so as to form a rigid mesh structure;

establishing a setting in the rigid mesh structure;

disposing the stone or jewel in the established setting;

and forming at least one prong over a portion of the stone or jewel by upsetting areas of the rigid mesh structure around the stone or jewel without requiring any subsequent electroplating step;

said step of forming at least one prong including providing a forming tool that chisels a link to create the prong extending over a peripheral edge of the stone or jewel.

2. The method of claim 1 wherein the metallic film is in the form of a liquid paste and the step of coating the liquid paste includes brushing the paste on the mesh structure using a brush.

3. The method of claim 2 wherein the heating step includes passing the mesh structure through a furnace so as to form a thin solder layer over the mesh structure to make the mesh structure rigid.

4. The method of claim 3 wherein the mesh structure is cleaned before coating the metallic film.

5. The method of claim 4 wherein after removal from the furnace, the rigidized mesh is then cleaned and tumbled.

6. The method of claim 5 wherein the setting is formed as a conical aperture in an area between links of the mesh structure.

7. The method of claim 1 wherein the step of forming at least one prong comprises using the forming tool to chisel a link to form multiple spacedly disposed prongs that are disposed at spaced intervals about the stone.

8. The method of claim 1 wherein the heating step includes passing the mesh structure on a belt through a furnace so as to form a thin solder layer over the mesh structure to make the mesh structure rigid.

9. The method of claim 1 wherein the step of establishing the setting includes drilling a hole in the rigid mesh structure and forming a conical aperture by means of a conical shaped bit.

10. The method of claim 1 wherein the forming tool chisels separate prongs that are spacedly disposed about the peripheral edge of the stone.

11. A method of attaching one or more stones or jewels to a flexible metallic mesh structure that is formed of a myriad of interconnected wound links, comprising the steps of:

cleaning the mesh structure;

coating a metallic film over the mesh structure;

said metallic film being coated in the form of a solder layer;

wherein the metallic film is in the form of a liquid paste and the step of coating the liquid paste includes brushing the paste on the mesh structure using a brush;

heating the mesh structure and the solder layer so as to form a rigid mesh structure;

wherein the heating step includes passing the mesh structure through a furnace so as to form a thin solder layer over the mesh structure to make the mesh structure rigid;

removing the mesh structure from the furnace;

after removal from the furnace cleaning the rigidized mesh structure;

establishing a setting in the rigid mesh structure;

wherein the setting is formed as a conical aperture in an area between links of the mesh structure;

disposing the stone or jewel in the established setting;

and forming at least one prong over a portion of the stone or jewel by upsetting areas of the rigid mesh structure around the stone or jewel without requiring any subsequent electroplating step;

said step of forming at least one prong including providing a forming tool that chisels a link to create the prong extending over a peripheral edge of the stone or jewel;

wherein the step of forming at least one prong comprises using the forming tool to chisel a link to form multiple spacedly disposed prongs that are disposed at spaced intervals about the stone.

12. The method of claim 11 wherein after removal from the furnace, the rigidized mesh is also tumbled.

13. The method of claim 12 wherein the heating step includes passing the mesh structure on a belt through the furnace so as to form a thin solder layer over the mesh structure to make the mesh structure rigid.

14. The method of claim 13 wherein the step of establishing the setting includes drilling a hole in the rigid mesh structure and forming a conical aperture by means of a conical shaped bit.

* * * * *